United States Patent [19]

Boedecker et al.

[11] Patent Number: 4,655,690

[45] Date of Patent: Apr. 7, 1987

[54] BELLOWS PUMP HAVING ADJUSTABLE STOP CAM FOR VARYING THE STROKE

[75] Inventors: Kay Boedecker, Chieming; Robert Scheurl, Inzell; Hans-Erwin Strasser, Siegsdorf, all of Fed. Rep. of Germany

[73] Assignee: Lang Apparatebau GmbH, Siegsdorf/Obb., Fed. Rep. of Germany

[21] Appl. No.: 800,365

[22] Filed: Nov. 21, 1985

Related U.S. Application Data

[63] Continuation-in-part of Ser. No. 631,038, Jul. 16, 1984, abandoned.

[30] Foreign Application Priority Data

Jul. 21, 1983 [DE] Fed. Rep. of Germany ..... 3326250

[51] Int. Cl.[4] ..... F04B 43/00; F01B 19/04

[52] U.S. Cl. ..... 417/53; 417/472; 417/63; 92/13.2; 92/13.4; 92/43; 92/47; 222/309

[58] Field of Search ..... 417/63, 53, 472; 92/43, 92/44, 47, 98 D, 13.2, 13.4, 134; 222/309

[56] References Cited

U.S. PATENT DOCUMENTS

| | | | |
|---|---|---|---|
| 862,867 | 8/1907 | Eggleston | 417/390 |
| 1,117,729 | 11/1914 | Ward | 92/13.4 |
| 1,495,772 | 5/1924 | Brown | 92/13.4 |
| 1,979,428 | 11/1934 | Wheeler | 222/309 |
| 2,920,656 | 1/1960 | Bertolet, Jr. | 92/47 |
| 2,947,470 | 8/1960 | Rubin et al. | 92/43 |
| 2,953,166 | 9/1960 | Carlson, Jr. | 92/98 D |
| 3,529,908 | 9/1970 | Smith | 92/47 |
| 4,081,111 | 3/1978 | Sandow | 222/309 |
| 4,144,761 | 3/1979 | Dzaach | 222/309 |
| 4,225,061 | 9/1980 | Blake | 417/472 |
| 4,433,799 | 2/1984 | Corsette | 222/309 |

FOREIGN PATENT DOCUMENTS

| | | | |
|---|---|---|---|
| 0070385 | 1/1983 | European Pat. Off. . | |
| 1393387 | 2/1965 | France . | |
| 924556 | 4/1963 | United Kingdom | 417/472 |
| 939529 | 10/1983 | United Kingdom . | |

*Primary Examiner*—Carlton R. Croyle
*Assistant Examiner*—Paul F. Neils
*Attorney, Agent, or Firm*—Ernest G. Szoke; Henry E. Millson, Jr.; Mark A. Greenfield

[57] ABSTRACT

A bellows pump with the improvement of an adjustable index for uniformly controlling the amount of fluid displaced in each expansion and compression cycle.

9 Claims, 2 Drawing Figures

BELLOWS PUMP HAVING ADJUSTABLE STOP CAM FOR VARYING THE STROKE

This application is a continuation-in-part of application Ser. No. 631,038, filed July 16, 1984, now abandoned.

BACKGROUND OF THE INVENTION

1. Field of the Invention

This invention relates to a mechanically operated bellows pump comprising a suction line and pressure line respectively communicating with the interior of the bellows through a suction valve and a pressure valve.

2. Description of the Related Art

The metering of liquid dishwashing and clothes washing preparations or rinsing aids for domestic machines or sinks is normally done by hand using measuring cups, lids, caps, or the like. Similarly, the metering of chemical preparations in the laboratory or in manufacturing is also frequently done by hand. Accordingly, contact between the chemical product in question and the skin cannot always be ruled out. In addition, the particular quantity measured depends very much on the person doing the measuring. For this reason, hand-operated metering pumps were introduced. In their case, the particular measured quantity is usually determined by the number of strokes. Unfortunately, the operator can easily miscount the number of strokes so that, once again, too much or too little product is dispensed. Moreover, conventional metering pumps which are generally in the form of piston pumps show a tendency towards rapid wear at the sealing elements and hence towards incorrect metering or failure.

SUMMARY OF THE INVENTION

The present invention provides a mechanically operated bellows pump which may be used as an adjustable small metering pump and by means of which a predetermined quantity of liquid may be introduced in a single stroke cycle. The pump comprises a suction line and pressure line respectively communicating with the interior of the bellows through a respective suction valve and pressure valve. The metering is achieved by limiting the stroke of the bellows using adjustable stop cams arranged on the pump body.

Accordingly, the invention provides a mechanical, preferably hand- or foot-operated, adjustable bellows pump of which the measured quantity may be predetermined by stop cams adjustable in particular based upon the principle of the index wheel. As a result, internal sealing (on the product side) may be entirely obtained by means of the bellows, which combines the functions of suction and compression and hence replaces the dynamic sealing elements previously required for metering pumps.

A counter-cam associated with the adjustable stop cam and movable with the operation of the bellows is preferably connected to the movable end of the bellows through an actuation cap which, in particular, covers the bellows. The counter-cam may consist of one or more component cams distributed equidistantly around the circumference of the actuation cap and designed to be moved at one and the same time. The actuation cap is intended to be mounted for rotation relative to the pump body, more particularly about the bellows axis, in such a way that stop cams or groups of individual stop cams differing in height axially of the bellows are situated opposite countercams which turn with the cap in various angular (rotational) positions of the actuation cap.

In order to prevent the pump according to the invention from being inadvertantly moved from a preset measured quantity, a turning lock in the form of a casing is associated with the actuation cap and, preferably, can only be released by complete removal.

Accordingly, the pump casing, which preferably surrounds the periphery of the pump in the region of the bellows and the stop cams and counter-cams and also in the region of the index wheel or stop ring, may advantageously perform the function of a safeguard against rotation of the actuation cap and of the counter-cam about the bellows axis and hence against inadvertant alteration of the preset measured quantity.

The pump casing performs another safety function by annularly surrounding the resilient index wheel or stop ring segments, which may be integrally formed with the pump body. As a result the counter-cams of the actuation cap are held fast by the stop ring segments through suppression of the spring travel, making it impossible for the actuation cap to spring out or to be withdrawn beyond the required end stop.

According to another aspect of the invention, the bellows pumps may be used as a small metering pump for chemicals. In this case in particular, it is best to make the bellows of a flexible plastic which is resistant to the particular chemicals, preferably polytetrafluoroethylene. In addition, to guarantee safe operation of the pump irrespective of position, the suction and pressure valves may be spring-loaded. Where the bellows pump according to the invention is used as a small metering pump for chemicals, the pressure lines and pressure valves may be designated as metering lines and metering valves, respectively.

BRIEF DESCRIPTION OF THE DRAWINGS

An embodiment of the invention is described in detail in the following with reference to the accompanying drawings, wherein.

DETAILED DESCRIPTION OF THE PREFERRED EMBODIMENTS

Figure 1:
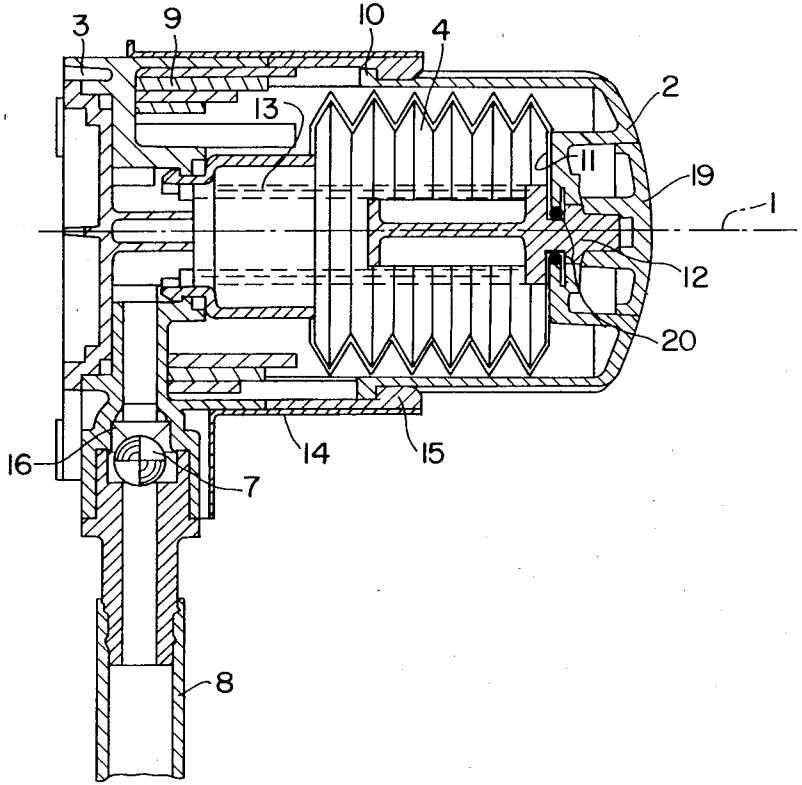
FIG. 1 is a section through a bellows pump along the bellows axis.
Figure 2:
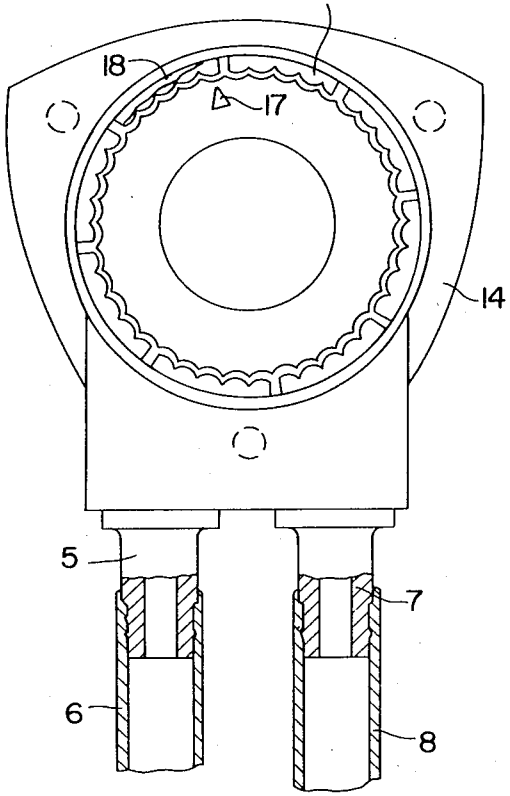
FIG. 2 is a section through the pump shown in FIG. 1 perpendicularly of the bellows axis.

In the embodiment illustrated in FIGS. 1 and 2, the bellows pump is designed for use as a small metering pump for chemicals. It contains a bellows 4 which is preferably circular in horizontal cross section and designed for compression along its axis 1 by the depression of an actuation cap 2 relative to the pump body 2 and with which a suction line 6 leading to a storage vessel (not shown) and a pressure or metering line 8 leading to the liquid or the like to be treated are associated through a suction valve 5 and a pressure or metering valve 7, respectively. An essential feature of the invention is that the compression stroke of the bellows in the axial direction 1 is limited by adjustable stop cams 9 arranged on the pump body 3. The stop cams are preferably annularly graduated (i.e. stepped) on the index wheel principle. The stop cams 9 may preferably be described as an index means comprising at least one set of ascending steps positioned on the pump body 3 in a concentric notional (imaginary) circle lying outside the periphery of the bellows 4 so that each counter-cam 10 can always interact with only one of the steps at a time (when the bellows 4 is compressed). In the embodiment illustrated, at least two counter-cams 10 movable simultaneously are associated with the stop cams 9 and may be connected through the actuation cap 2 to the movable end 11 of the bellows. The particular measured quantity required may be set by rotating the actuation cap 2 relative to the pump body 3 about the bellows axis 1. In that case, the counter-cams 10 connected to the actuation cap 2 (and preferably integral therewith) would be moved until they were opposite the stop cams 9 at the particular level required. The stop cams may differ in height in stages in the direction of the axis 1. They may also differ in height continuously from the highest to the lowest stop cam 9. Advantages are afforded by two or more equidistant series of graduated stop cams 9 with respective counter-cams 10 associated with each series.

To prevent the pump from being inadvertantly changed from a given measured quantity, the actuation cap 2 on its outer circumference, the area over which the actuation cap is accommodated on the pump body 3, and the index wheel or stop ring segments 15, are internally profiled in such a way that, if the actuation cap is turned and hence the stroke setting altered, and index wheel or stop ring segments 15 have to give way resiliently. The presence of the casing 14 neutralizes the resilience of the segments and hence prevents inadvertant alteration of the stroke. Accordingly, adjustment of the measured quantity delivered by the pump may advantageously be carried out on an indexing stop principle so that the stroke length and hence the required volume may be safely preset without any danger of inadvertant alteration or subjective influences.

As a further embodiment, means may be provided for indicating the volume to which the pump has been set. Such means could comprise a measured quantity indicator 18 located on a non-moving part of the pump such as the casing 14 associated with a regulator arrow 17 located on the actuation cap 2. When the actuator cap 2 is swiveled around its axis 1, thereby aligning the counter-cams 10 with a particular level of the indexed stop cams 9, the regulator arrow 17 will point to a corresponding point on the measured quantity indicator 18.

To carry out metering with the pump, the actuation cap 2 is pressed by hand (or by foot) against the adjusted stop cams 9. The bellows 4 is then compressed and the chemical accommodated in the bellows is expelled, i.e. dispensed, through the pressure or metering valve 7, which is preferably a pivot valve or ball valve. During the return stroke brought about by the compression spring 13 and/or by the bellows' own resilience, chemicals are drawn from a container through the suction line 6 and the suction valve 5, which is preferably another pivot or ball valve, into the interior of the bellows 4. The pump becomes independent of orientation, i.e. it may be installed and actuated in any position, if the suction valve 5 and the pressure valve 7 are biased by a loading spring 16.

The actuation cap 2 is attached to the bellows 4 in the following manner. The turning lock 12 at its lower end is rotatably mounted within the upper opening of the bellows 4, by means of flanges above and below the opening as shown in FIG. 1. The upper end of the turning lock 12 is not removable, but is rotatably mounted within the actuation cap 2, so that the cap 2 may be rotated to move the countercams 10 without distorting the flexible bellows 4. An end cap 19 tightly, and axially immoveably biases against the top end of the turning lock 12 and maintains the actuation cap 2 from being removed. The end cap 19 also acts to keep the annular central flange of the actuation cap 2 slideably biased against the annular central top opening of the bellows 4 in cojunction with an O-ring 20, which surrounds the annular top opening. Thus, the turning lock 12 and end cap 19 form a unitary structure, after assembly, which acts to rotatably mount the actuation cap 2 on the top end of the bellows 4. As shown in FIG. 1, the turning lock 12 and end cap 19 have a friction fit. All other means of fixedly fastening these elements are also within the scope of this invention.

It also should be clarified that both the inlet 6 and outlet 8 have valves, namely suction valve 5 on inlet (or suction) line 6 and metering (or pressure) valve 7 on outlet (or metering) line 8.

We claim:

1. In a mechanically operated bellows pump having a pump body with intake and exit conduits and a flowingly connected central conduit, a bellows circular in cross-section and operatively connected to said central conduit, means for expanding and compressing said bellows, means for connectively positioning one end of said bellows above said central conduit, and valve means for controlling the flow of fluids entering said intake conduit and leaving said exit conduit, so that when said bellows is expanded it sucks fluid in through said intake conduit and holds said fluid within the bellows itself and when said bellows is compressed it forces said fluid out of said exit conduit, the improvement comprising means for uniformly controlling the amount of fluid displaced by said pump in each expansion and compression cycle, said means comprising at least one adjustable stop cam mounted on said pump body and at least one associated counter-cam connected to the moveable end of said bellows, so that the length of the compression stroke of said bellows is determined by the point at which each said stop cam and counter-cam interacts; said stop cams being an index means comprising at least two sets of ascending steps positioned on said pump body in a concentric notional circle lying outside the periphery of said bellows, each said set being equidistantly spaced from each other about said notional circle, so that each said counter-cam can always interact with only one said step at a time; the moveable end of said bellows being surmounted by an actuation cap which fixedly connects said at least one counter-cam with said moveable end; and wherein a turning lock in the form of a casing is associated with said actuation cap and can only be released by complete removal.

2. The improved pump of claim 1 wherein said at least one counter-cam is integral with said actuation cap.

3. The improved pump of claim 1 wherein said at least one counter-cam is moveable with relation to said at least one stop cam by revolving said at least one counter-cam about the central axis of said bellows.

4. The improved pump of claim 1 wherein the expansion stroke of said bellows is limited by a resilient stop ring which interacts with said at least one counter-cam when the bellows is expanded to a given extent, and which stop ring is fixedly connected to said pump body.

5. The improved pump of claim 4 wherein said pump is surrounded by an annular casing in the region of said at least one stop cam, said at least one counter-cam and said resilient stop ring, so that said resilient stop ring is held in place and fixedly connected to said pump body.

6. The improved pump of claim 1 wherein said valve means are spring-loaded valves.

7. The improved pump of claim 6 wherein said bellows are made of a flexible plastic.

8. The improved pump of claim 7 wherein said plastic is a polytetrafluoroethylene.

9. A method for metering liquid chemical preparations employing a mechanically operated bellows pump having a pump body with intake and exit conduits and a flowingly connected central conduit, a bellows circular in cross-section and operatively connected to said central conduit, means for expanding and compressing said bellows, means for connectively positioning one end of said bellows above said central conduit, and valve means for controlling the flow of fluids entering said intake conduit and leaving said exit conduit, so that when said bellows is expanded it sucks fluid in through said intake conduit and holds said fluid within the bellows itself and when said bellows is compressed it forces said fluid out of said exit conduit, means for uniformly controlling the amount of fluid displaced by said pump in each expansion and compression cycle, said means comprising at least one adjustable stop cam mounted on said pump body and at least one associated counter-cam connected to the moveable end of said bellows, so that the length of the compression stroke of said bellows is determined by the point at which each said stop cam and counter-cam interacts; said stop cams being an index means comprising at least two sets of ascending steps positioned on said pump body in a concentric notional circle lying outside the periphery of said bellows, each said set being equidistantly spaced from each other about said notional circle, so that each said counter-cam can always interact with only one said step at a time; the moveable end of said bellows being surmounted by an actuation cap which fixedly connects said at least one counter-cam with said moveable end; and wherein a turning lock in the form of a casing is associated with said actuation cap and can only be released by complete removal, said method comprising:

setting said index means to a desired volume to be metered;

locking said turning lock so that said volume cannot be altered without releasing said turning lock; and compressing and releasing said bellows to discharge and meter said liquid chemical.

* * * * *